US006877842B2

(12) United States Patent
Moon et al.

(10) Patent No.: US 6,877,842 B2
(45) Date of Patent: Apr. 12, 2005

(54) BUBBLE-JET TYPE INK-JET PRINTHEAD

(75) Inventors: Jae-ho Moon, Suwon (KR); Dae-soon Lim, Yongin (KR); O-hyun Baek, Seoul (KR)

(73) Assignee: Samsung Electronics Co., LTD, Suwon (KR)

( * ) Notice: Subject to any disclaimer, the term of this patent is extended or adjusted under 35 U.S.C. 154(b) by 56 days.

(21) Appl. No.: 10/171,679

(22) Filed: Jun. 17, 2002

(65) Prior Publication Data

US 2002/0149649 A1 Oct. 17, 2002

Related U.S. Application Data

(62) Division of application No. 09/836,332, filed on Apr. 18, 2001, now abandoned.

(30) Foreign Application Priority Data

Jul. 26, 2000 (KR) ..... 00-43006

(51) Int. Cl.[7] ..... B41J 2/05
(52) U.S. Cl. ..... 347/62
(58) Field of Search ..... 347/56, 61, 62, 347/63

(56) References Cited

U.S. PATENT DOCUMENTS 4,870,433 A * 9/1989 Campbell et al. ..... 347/62
4,914,562 A * 4/1990 Abe et al. ..... 347/63
6,019,457 A * 2/2000 Silverbrook ..... 347/65

FOREIGN PATENT DOCUMENTS

KR U1993-8456 5/1993

* cited by examiner

*Primary Examiner*—Michael S. Brooke
(74) *Attorney, Agent, or Firm*—Robert E. Bushnell, Esq.

(57) ABSTRACT

A bubble-jet type ink-jet printhead is provided. When forming a doughnut-shaped bubble, the printhead allows bubbles to be first grown around the heater that surrounds the central axis of the nozzle at regular angles followed by the formation of another bubble between the earlier formed bubbles, thereby forming a larger doughnut-shaped bubble. Accordingly, this can prevent the formation of an unbalanced doughnut-shaped bubble due to variations in local resistance of the heater, which may be caused by a process error. Furthermore, the printhead allows the center of the doughnut-shaped bubble to be set on the central axis of the nozzle thus causing a droplet formed within the doughnut-shaped bubble to be ejected in a normal manner, that is, in a direction vertical to the nozzle plate.

21 Claims, 12 Drawing Sheets

BUBBLE-JET TYPE INK-JET PRINTHEAD

CROSS-REFERENCE TO RELATED APPLICATIONS

This Application is a divisional application of U.S. application Ser. No. 09/836,332, filed on Apr. 18, 2001, incorporated herein by reference. This application also makes reference to, incorporates the same herein, and claims all benefits and priority under 35 U.S.C. §120 of the aforementioned U.S. application Ser. No. 09/836,332, filed on Apr. 18, 2001, now abandoned.

CLAIM OF PRIORITY

This application makes reference to, incorporates the same herein, and claims all benefits accruing under 35 U.S.C. §119 and §120 from my application entitled BUBBLE-JET TYPE INK-JET PRINTHEAD filed with the Korean Industrial Property Office on Jul. 26, 2000 and there duly assigned Serial No. 2000/43006.

BACKGROUND OF THE INVENTION

1. Field of the Invention

The present invention relates to an ink-jet printhead, and more particularly, to a bubble-jet type ink-jet printhead. In particular, this invention pertains to novel ink jet heater shapes used in novel ink jet printhead structures.

2. Description of the Related Art

The ink ejection mechanisms of an ink-jet printer are largely categorized into two types: an electro-thermal transducer type (bubble-jet type) in which a heat source is employed to form a bubble in ink causing ink droplets to be ejected, and an electromechanical transducer type in which a piezoelectric crystal bends to change the volume of ink causing ink droplets to be expelled.

An ideal ink-jet print head is 1) easy to manufacture, 2) produces high quality color images, 3) is void of crosstalk and backflow between nozzles, and 4) is capable of high speed printing. Efforts to achieve these goals are found in U.S. Pat. Nos. 4,339,762; 4,882,595; 5,760,804; 4,847,630; 5,850,241; and 6,019,457, European Patent No. 317,171, and Fan-Gang Tseng, Chang-Jin Kim, and Chih-Ming Ho, "A Novel Microinjector with Virtual Chamber Neck", IEEE MEMS '98, pp. 57–62. However, ink-jet printheads proposed in the above patents or literature may only satisfy some of the aforementioned requirements but do not completely provide an improved ink-jet printing approach.

SUMMARY OF THE INVENTION

It is therefore an object of the present invention to provide an improved ink jet printhead.

It is also an objective of the present invention to provide a bubble-jet type ink-jet printhead that allows a doughnut-shaped bubble to grow with balanced expansion force with respect to every direction of an annular heater.

It is another objective of the present invention to provide a bubble-jet type ink-jet printhead that facilitates the manufacture of a heater for generating doughnut-shaped bubbles with balanced distribution.

It is further an object to provide novel ink jet printhead designs that utilize efficiently the annular heater about a nozzle hole, where the resistance of the annular heater varies at regular intervals along the length of the heater.

It is still an object to provide variations in designs of the annular heater.

Accordingly, to achieve the above objectives, the present invention provides a bubble-jet type ink jet printhead having a nozzle plate including a nozzle, through which ink is ejected; a substrate which supports the nozzle plate, wherein an ink chamber corresponding to the nozzle is disposed between the substrate and the nozzle plate; a heater formed in such as way as to surround the central axis of the nozzle, the resistance of which varies at regular intervals; and electrodes which apply current to the heater. The heater is formed on the front surface or the rear surface of the nozzle plate or the top surface of the substrate. Also, the heater has either a doughnut shape or a polygonal shape which surrounds the central axis of the nozzle, wherein one section of the doughnut shape or the polygonal shape is open. Alternatively, the heater has a doughnut shape or a polygonal shape, which is completely closed.

The electrodes are electrically coupled to both ends of the open portion of the heater. Also, the electrodes are electrically coupled to opposite ends of the heater, which form 180° with each other. The resistance of the heater is adjusted by the width or the height of the heater. The heater is formed or the top surface of the substrate.

The nozzle plate adheres to the substrate, and a predetermined volume of ink chamber, which has preferably a hemispherical shape, is formed in a portion of the substrate corresponding to the nozzle of the nozzle plate. An ink channel for supplying ink is formed in the ink chamber, and the heater is formed on the front surface or the rear surface of the nozzle plate in such a way as to surround the central axis of the nozzle corresponding thereto.

Alternatively, the nozzle plate and the substrate are spaced apart by a predetermined distance, and walls for forming a common chamber filled with ink between the nozzle plate and the substrate are disposed on the edges between the nozzle plate and the substrate. In this case, the heater corresponding to the nozzle of the nozzle plate is formed on the substrate.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
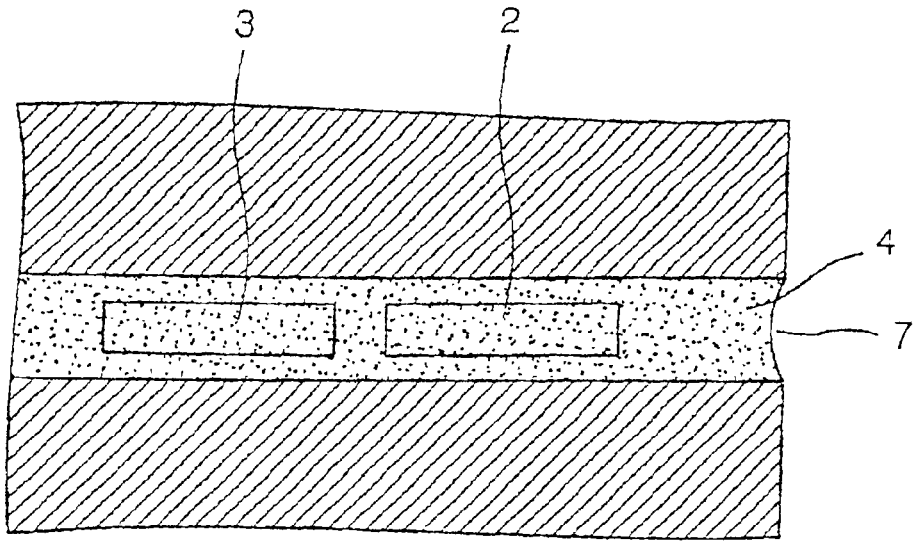
FIGS. 1 and 2 are cross-sectional views showing the structure of a bubble-jet ink jet printhead along with an ink ejection mechanism.
Figure 2:
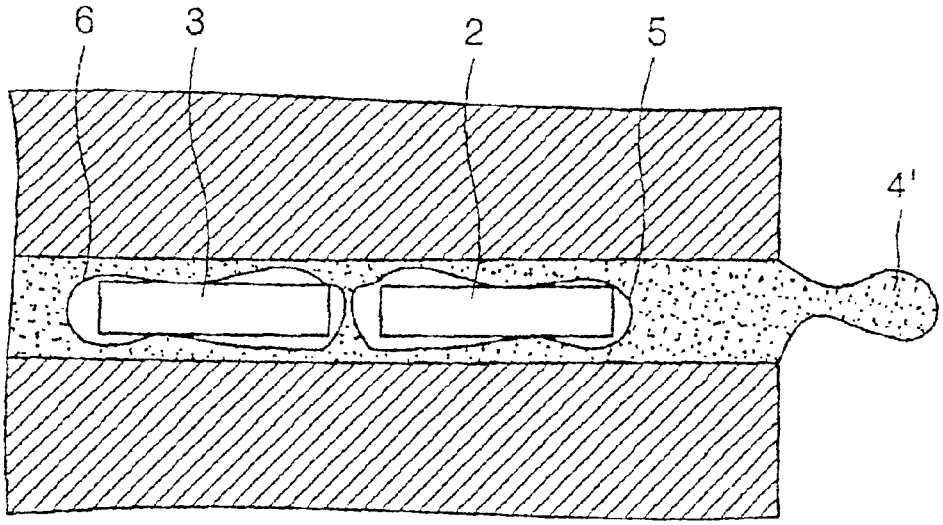

Referring to FIGS. 1A and 1B, a bubble-jet type ink ejection mechanism will now be described. When a current pulse is applied to a first heater 2 consisting of resistive heating elements located at an ink channel 1 where a nozzle 7 is formed, heat generated by the first heater 2 boils ink 4 forming a bubble 5 within the ink channel 1, which causes an ink droplet 4' to be ejected.

Meanwhile, a bubble-jet type ink-jet printhead having the ink ejector as described above needs to meet the following conditions. First, a simplified manufacturing process, low manufacturing cost, and high volume production must be allowed. Second, to produce high quality color images, creation of minute satellite droplets that trail ejected main droplets must be prevented. Third, when ink is ejected from one nozzle or ink refills an ink chamber after ink ejection, cross-talk with adjacent nozzles from which no ink is ejected must be prevented. To this end, a back flow of ink in the opposite direction of a nozzle must be avoided during ink ejection. A second heater 3 shown in FIGS. 1A and 1B is provided for preventing the back flow of the ink. The second heater 3 generates heat sooner than the first heater 2 for a bubble 6 to shut off the ink channel 10 to the rear of the first heater 2. Then, the first heater 2 generates heat thus causing the ink droplet 4' to be ejected by expansion energy of the bubble 5. Fourth, for a high speed print, a cycle beginning with ink ejection and ending with ink refill must be as short as possible. However, the above conditions tend to conflict with one another, and furthermore, the performance of an ink-jet printhead is closely related to the structures of an ink chamber, an ink channel, and a heater, the type of formation and expansion of bubbles associated therewith, and the relative size of each component. A bubble having a normal doughnut shape or a polygonal frame shape surrounding the central axis of a nozzle is hereinafter collectively referred to as an "annular bubble".

Figure 3:
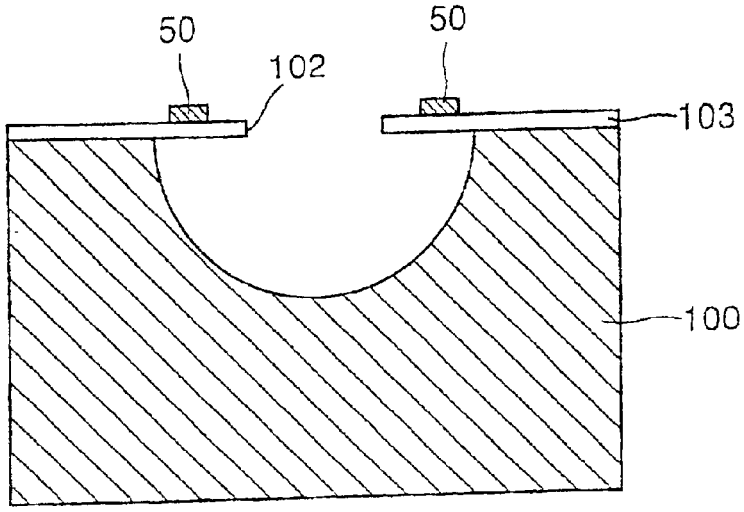
FIG. 3 is a schematic cross-sectional view of an ink-jet printhead according to a first embodiment of the present invention.
Figure 4:
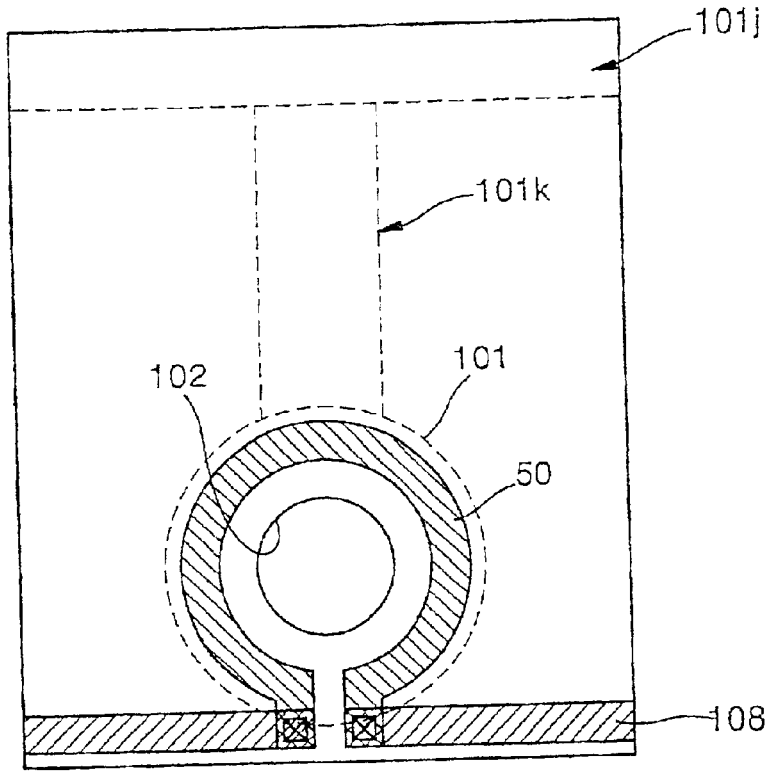
FIG. 4 is a schematic top view of the ink-jet printhead according to the first embodiment of the present invention shown in FIG. 3.

First, referring to FIGS. 3 and 4 showing an ink-jet printhead according to a first embodiment of the present invention, a hemispherical ink chamber 101 is formed in a substrate 100, and a nozzle plate 103, in which a nozzle 102 is formed, is attached to the substrate 100. The substrate 100 is obtained from a silicon wafer, and the ink chamber 101 is obtained by etching processing for a silicon wafer. An annular or omega-shaped heater 50 formed above the ink chamber 101 is positioned around the nozzle 102 (or orifice) corresponding to the ink chamber 101.

Signal lines 108 formed on the nozzle plate 103 for supplying current are connected to the ends of the heater 50. Referring to FIG. 4, the ink channel 101*k* connected to the ink chamber 101 is formed on the substrate 100 disposed below the nozzle plate 103 and connected to a manifold 101*j* for supplying ink. The ink-jet printhead having a structure as described above is characterized in that a doughnut-shaped bubble is generated by an annular or omega-shaped heater, and the detailed structure of the heater 50 will be later described through various types of modified examples.

Figure 5:
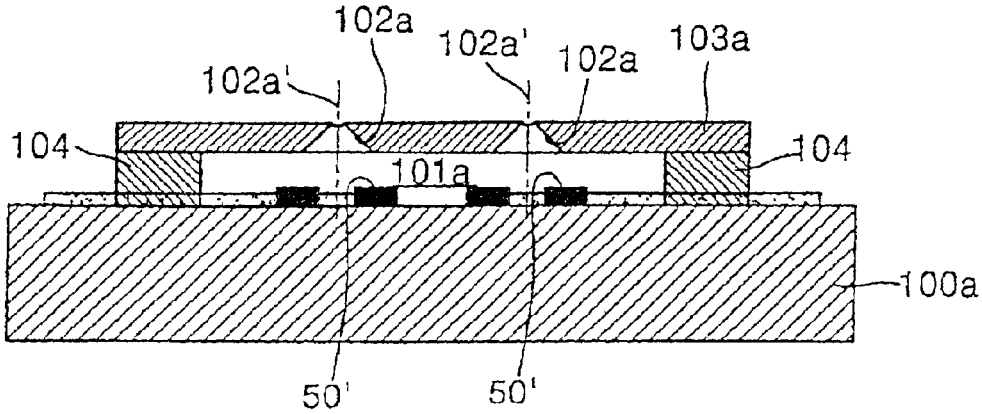
FIG. 5 is a cross-sectional view of an ink-jet printhead according to a second embodiment of the present invention.
Figure 6:
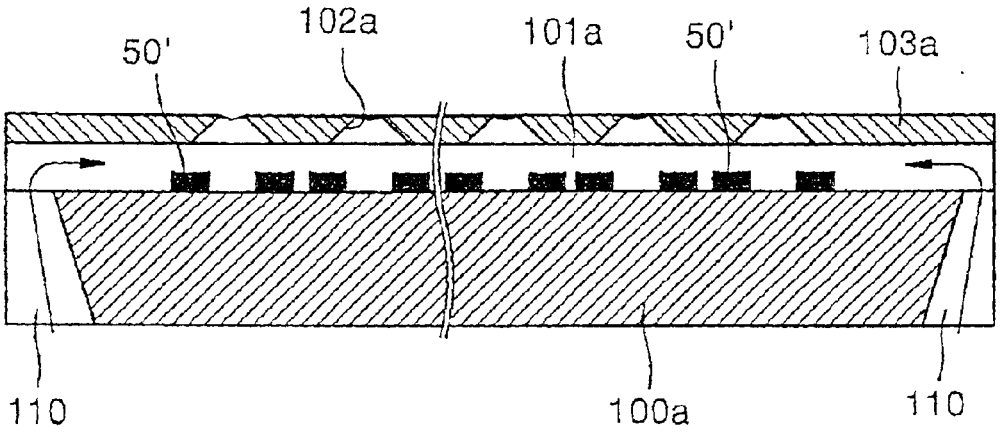
FIG. 6 is a longitudinal sectional view of the ink-jet printhead according to the second embodiment of the present invention shown in FIG. 5.
Figure 7:
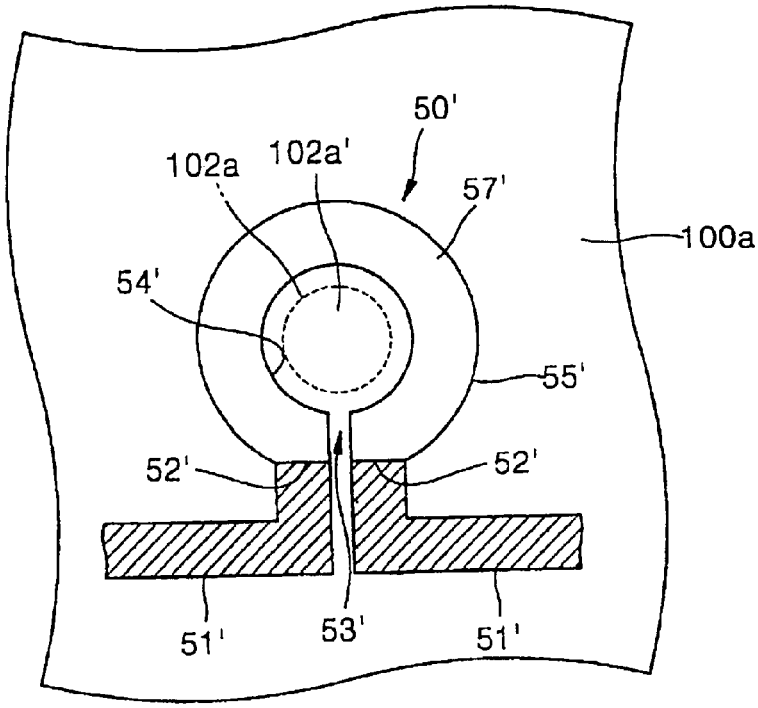
FIG. 7 is top view showing a basic example of an annular or doughnut-shaped heater applied to an ink-jet printhead according to the present invention.

Referring to FIGS. 5 and 6, which shows a bubble-jet type ink-jet printhead according to a second embodiment of the present invention, a common chamber 101*a* is provided in a space between a substrate 100*a* and a nozzle plate 103*a* by both walls 104. Also, an omega-shaped or doughnut-shaped heater 50' as shown in FIG. 7 is formed in such a way as to surround a central axis 102*a*' of a nozzle 102*a*. The heater 50' is formed corresponding to each nozzle 102*a*. In FIG. 7, electrodes 51' are electrically attached to ends 52' of open section 53' of heater 50'. Heater 50' has an inner edge 54' and an outer edge 55', both of which are circular. Between inner edge 54' and outer edge 55' is body 57' of heating element 50'. As shown in FIG. 6, ink feed holes 110 are disposed at both ends of the substrate 100*a*. The ends of the common chamber 101*a* are not sealed by a wall. However, when the head 100 is inserted into a head mount portion of a cartridge (not shown), the ends of the common chamber 101*a* are sealed by a sealing member, in which case the ink feed grooves 110 are connected with the inside of the cartridge 300 for supplying ink. According to the bubble-jet type ink-jet printhead having a structure as described above, a virtual chamber is formed within a bubble formed by the annular or omega-shaped heater 50' and then ink present in the virtual chamber is ejected through the nozzle 102*a*.

The ink-jet printhead is constructed such that the space between the nozzle plate and the substrate forms a common chamber and there is no ink channel having a complicated structure, thereby significantly suppressing the clogging of nozzles by foreign materials or solidified ink. The ink-jet printhead is easy to design and manufacture due to its simple structure thereby significantly reducing the manufacturing cost. In particular, its simple structure permits flexibility in selecting a wide range of alternative designs and thus patterns in which the nozzles are arranged. In particular, the printhead according to the present invention can be manufactured by a fabrication process for a typical semiconductor device, thereby facilitating high volume production. Furthermore, the virtual chamber formed by the doughnut-shape bubble prevents a back flow of ink thereby avoiding cross-talk between adjacent nozzles. In particular, ink refills in the virtual chamber for each nozzle from every direction, thereby allowing for continuous high-speed ink ejection. One objective of the ink-jet printheads having the new structures as described hereinbefore is to produce doughnut-shaped bubbles by heat generated by the annular or doughnut-shaped heater with balanced distribution and thus generate balanced expansion energy in every direction of the heater.

Referring to FIGS. 8–11, an applied example of the heater 50 and 50' applied to the bubble-jet type ink-jet printhead will now be described. First, referring to FIG. 8, the heater 50*a* has a circular inner edge 54*a* and a polygonal outer edge 55*a*, wherein the corners 56*a* of outer edge 55*a* are rounded. Between inner edge 54*a* and outer edge 55*a* is body 57*a* of heater 50*a*. Body 57*a* has varying widths at varying locales about heater 50*a*. Thus, the heater 50*a* includes a low resistance portion 'B', in which the width is large, and a high resistance portion 'A', in which the width is small. Two low resistance portions 'B', which are symmetrical to each other, are coupled to electrodes 51*a*, respectively. Thus, a parallel circuit of resistors having two current paths is constructed between both electrodes 51*a*. Predetermined current is applied to the heater 50*a* through both electrodes 51*a*, and then the entire heater 50*a* starts to generate heat. In this case, with respect to speed at which a temperature rises, the high resistance portion A is faster than that of the low resistance portion B. Thus, the temperature at each portion of the heater 50*a* varies due to the difference in the speed at which the temperature rises. As shown in the left side of FIG. 9, first, a bubble A' is formed due to a sharp temperature rise at the high resistance portion A of the heater 50*a*, and then, as shown in the right side of FIG. 9, the bubble A' generated at the high resistance portion A further grows and a bubble B' starts to be formed at the low resistance portion B as well. That is, when a predetermined period of time has lapsed after application of the current, the bubbles A' and B' formed by ink heated by the heater 50*a* have the difference in sizes corresponding to the heat generation amount, and differences in-the sizes of the bubbles A' and B' are entirely symmetrical or balanced.

In this way, the present invention artificially imparts periodical changes in resistance to the heater 50*a* when designing and manufacturing the heater 50*a*, thereby allowing for balanced heat generation by the entire heater 50*a* and thus symmetrical bubble growth. The reason for artificially imparting periodical changes in resistance will be more easily understood by what will be described below.

Figure 10:
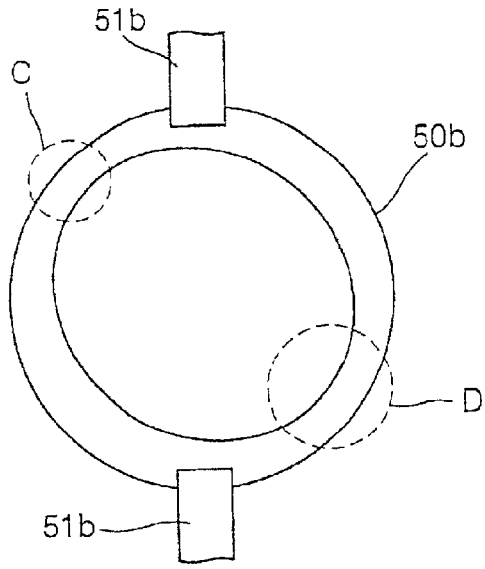
FIG. 10 shows an abnormally formed doughnut-shaped heater which is originally designed as a normal circle.

FIG. 10 shows a doughnut-shaped heater 50*b* which was originally designed as a is normal circle. Referring to FIG. 10, opposite ends of the heater 50*b*, designed and manufactured such that both inner and outer edges may have circular shapes, are coupled to electrodes 51*b*. Unlike the design of the heater 50' in FIG. 7, during an actual manufacture, resistance of the heater 50*b* itself is not made uniform due to variations in local etching amount of the heater 50*b*. Changes in local resistance of the heater 50*b* cannot be predicted since they are caused by errors during material deposition and etching processes during formation of the heater 50*b*.

C and D in FIG. 10, which may be created by a process error, denote high resistance portions having higher resistance than the other portions, and there may be difference in resistance between both high resistance portions C and D. Thus, the resistance of a heater 50*b* as shown in FIG. 10 is connected in parallel, and the high resistance portions C and D having a high temperature rise rate compared to the other portions exist in parallel. In this case, since bubbles are firstly formed at the high resistance portions C and D as described above, the bubble is formed in an abnormal manner, for example, the overall shape of the bubble is distorted or one side of the bubble is vacant. This abnormal formation of the bubbles may cause ink within an ink chamber to be ejected in an abnormal direction.

Figure 8:
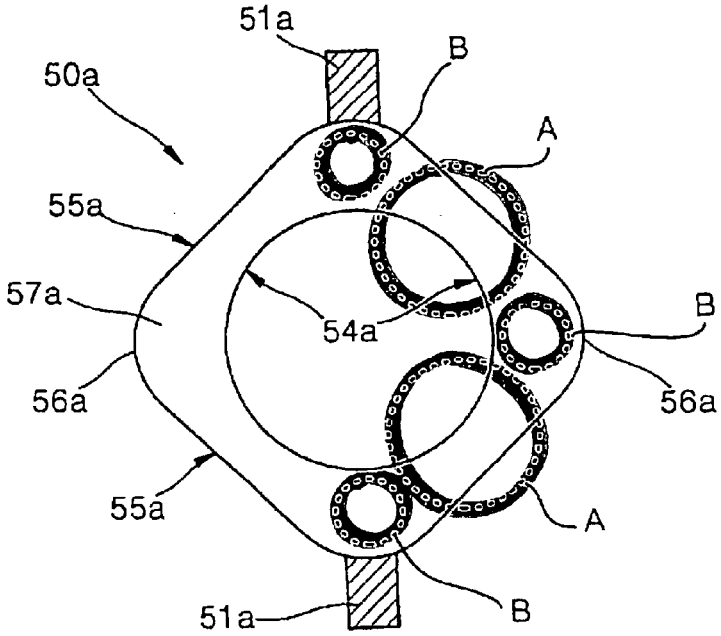
FIG. 8 is a first applied example of a heater applied to an ink-jet printhead according to the present invention.
Figure 9:
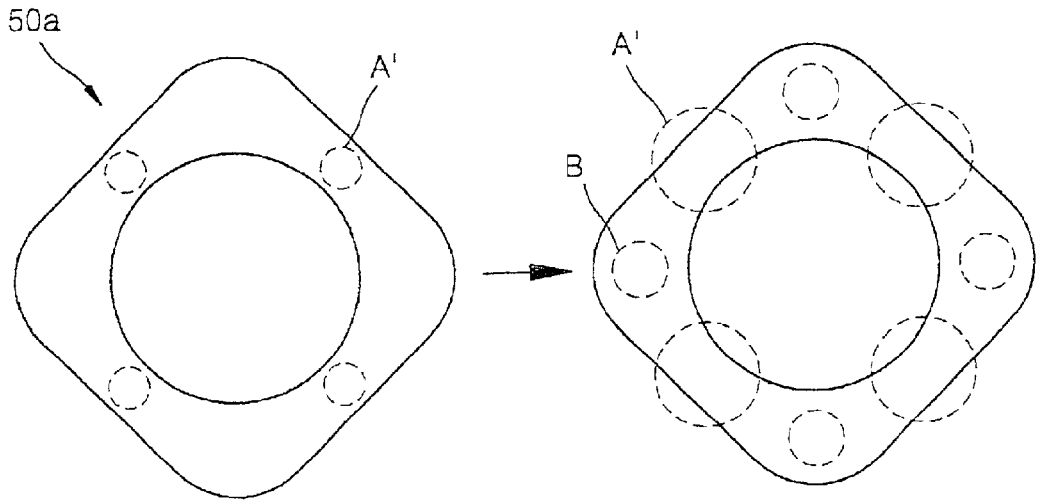
FIG. 9 shows a state in which bubbles are formed by the heater according to the present invention shown in FIG. 8.
Figure 11A:
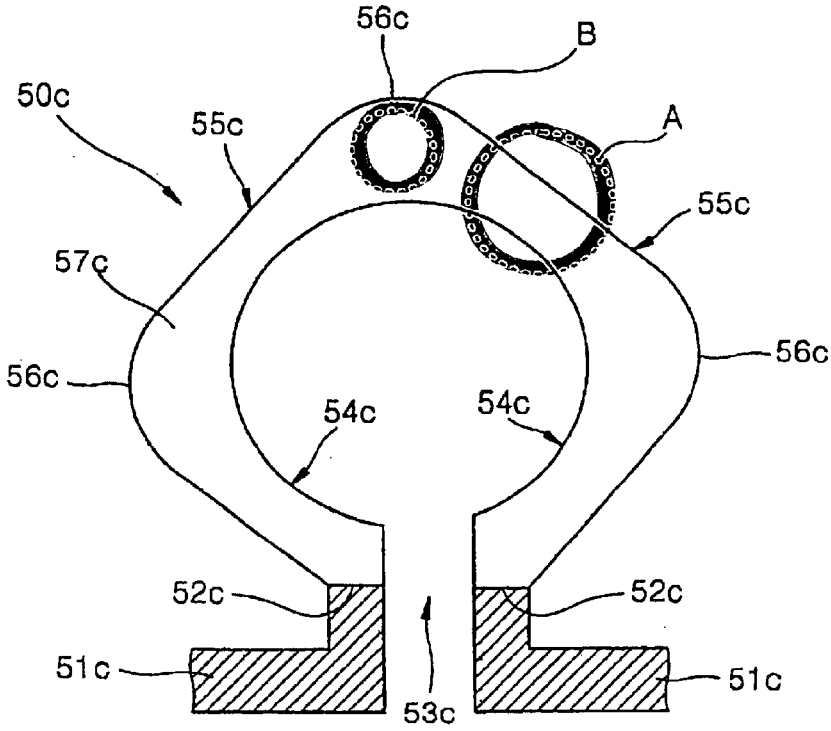
FIGS. 11A and 11B are second and third applied examples of a heater applied to an ink-jet printhead according to the present invention.
Figure 11B:
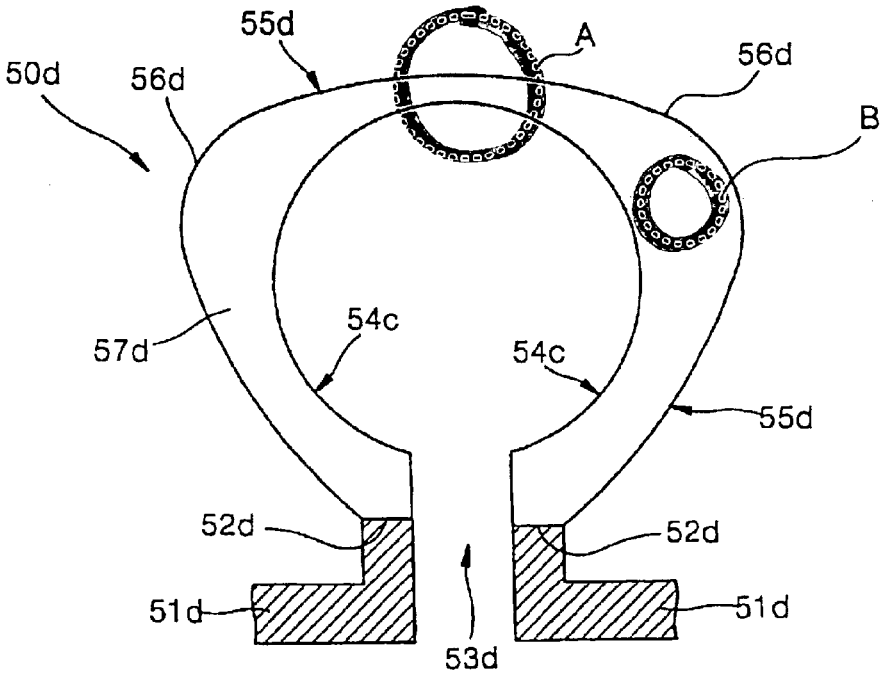

To overcome this drawback, as shown in FIG. 8, the present invention adjusts the shape of the heater 50*a* from the design stage so as to make abnormally shaped bubbles due to a process error normal, symmetrical, and balanced in practice. Heaters 50*c* and 50*d* shown in FIGS. 11A and 11B have a shape, one side of which is open, and includes a high resistance portion A and a low resistance portion B like the heater 50*a* shown in FIG. 8. As shown in FIGS. 11A and 11B, predetermined current is applied to the heaters 50*c* and 50*d* through electrodes 51*c* and 51*d*, respectively, corresponding to the shape of the heaters 50*c* and 50*d*, which causes the entire heaters 50*c* and 50*d* to generate heat. In FIG. 11A, electrodes 51*c* are electrically connected to ends 52*c* of open section 53*c* of heater 50*c*. Heater 50*c* has a circular inner edge 54*c* and a polygonal outer edge 55*c* having three corners 56*c* of outer edge 55*c* which are rounded. Between inner edge 54*c* and outer edge 55*c* is body 57*c* of heater 50*c*. Body 57*c* has varying widths at varying locales on heater 50*c*. Meanwhile, FIG. 11B illustrates electrodes 51*d* being electrically connected to ends 52*d* of open section 53*d* of heater 50*d*. Like FIG. 11A, FIG. 11B has a circular inner edge 54*d* and a polygonal outer edge 55*d*. Unlike FIG. 11A, FIG. 11B has only two rounded corners 56*d* instead of 3. Although FIGS. 11A and 11B illustrate heaters having 3 or 2 rounded corners, respectively, variations of the present invention encompass outer edges of heaters having any number of corners being rounded. Between inner edge 54*d* and outer edge 55*d* is body 57*d* of heater 50*d* of FIG. 11B. As with FIG. 11A, body 57*d* has varying widths at different locales on heater 50*d*. In these cases, a temperature rise rate at the high resistance portion A is higher than that at the low resistance portion B due to the difference in resistance at each portion of the heaters 50*c* and 50*d*. Thus, a temperature at each portion of the heaters 50*c* and 50*d* varies due to the difference in the temperature rise rate, thus forming bubbles in a way similar to that shown in FIG. 9. Meanwhile, although the resistance of the heaters 50*c* and 50*d* may vary due to the difference in the widths of the heaters 50*c* and 50*d*, it is possible to vary the resistance thereof by a change in thickness.

Figure 12A:
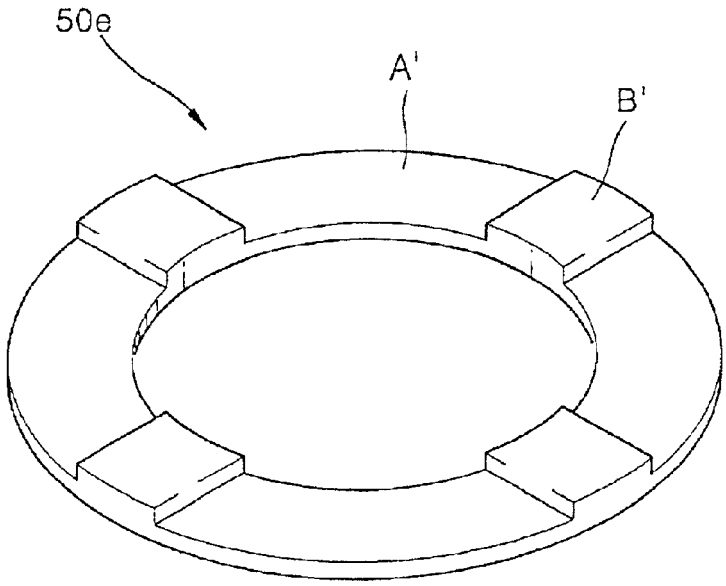
FIGS. 12A and 12B are fourth and fifth examples of a heater applied to an ink-jet printhead according to the present invention.
Figure 12B:
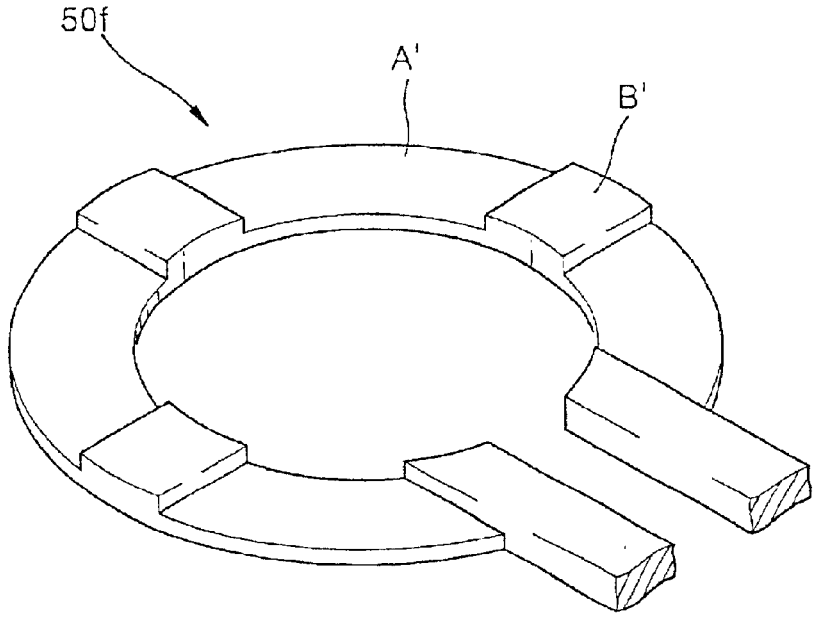

FIGS. 12A and 12B show a doughnut shaped heater 50*e*, which is completely closed, and a doughnut-shaped heater 50*f*, one side of which is open, respectively. As shown in FIGS. 12A and 12B, each of the heaters 50*e* and 50*f* has a low resistance portion B' having low resistance due to a large thickness and a high resistance portion A' having higher resistance due to a small thickness than the low resistance portion B'. The difference in resistance causes bubbles to be generated through the heaters 50*e* and 50*f* in a way similar to that shown in FIG. 9.

Figure 13A:
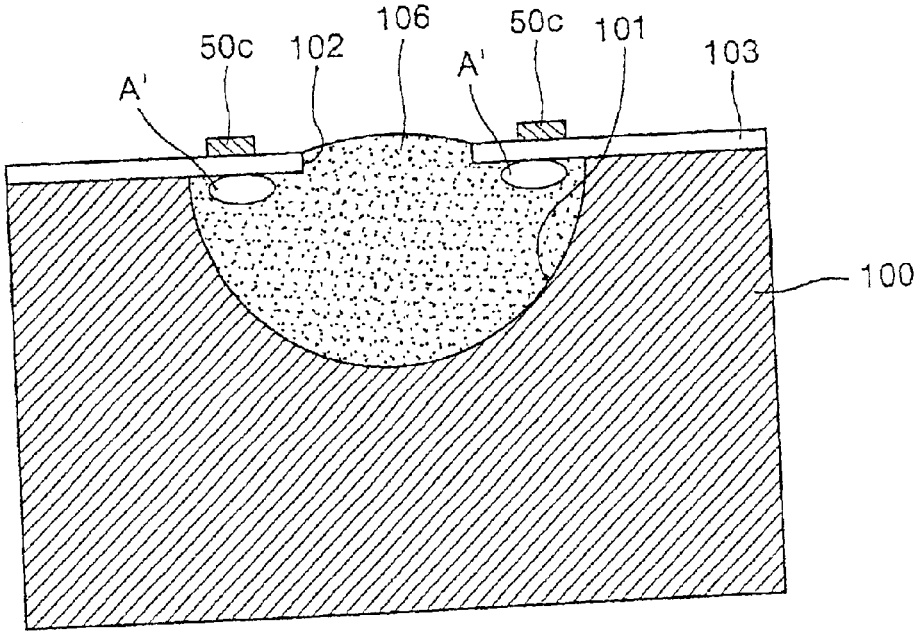
FIG. 13A is a cross-sectional view showing an early stage of bubble formation by the heater in the ink-jet printhead according to the first embodiment of the present invention.
Figure 13B:
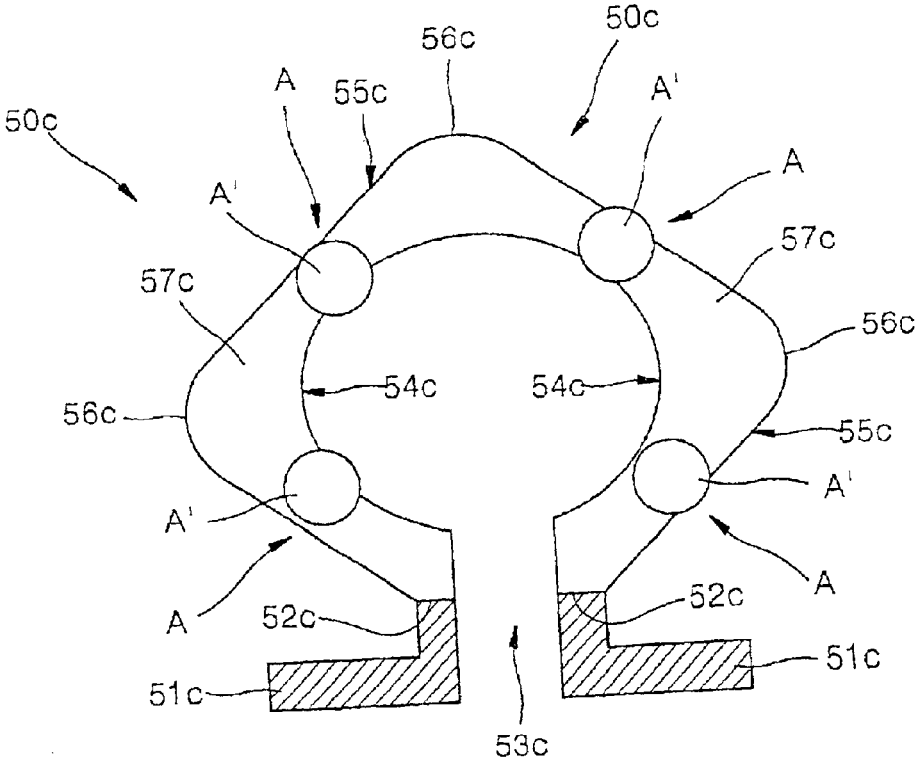
FIG. 13B is a top view of the heater at that time.

An example in which the heater 50*c* shown in FIG. 11A among the thus-structured heaters is applied to the ink-jet printhead according to the present invention shown in FIG. 3 will now be described. FIG. 13A shows a structure in which the heater 50*c* shown in FIG. 11A is applied to the ink-jet printhead shown in FIG. 3. Referring to FIG. 13A, the heater 50*c* that features the ink-jet printhead according to the present invention is formed on the nozzle plate 103. The heater 50*c* is formed in such a way as to surround the nozzle 102 of the nozzle plate 103. Upon applying current to the heater 50*c*, heat is generated from the improved heater 50*c* and then a bubble A' starts to be formed at the high resistance portion A where a temperature rises at the highest speed. In this case, as shown in FIG. 13B, the bubbles A' are formed at the high resistance portions A arranged at regular angles thereby imposing pressure on ink 106 within the ink chamber 101.

Figure 14A:
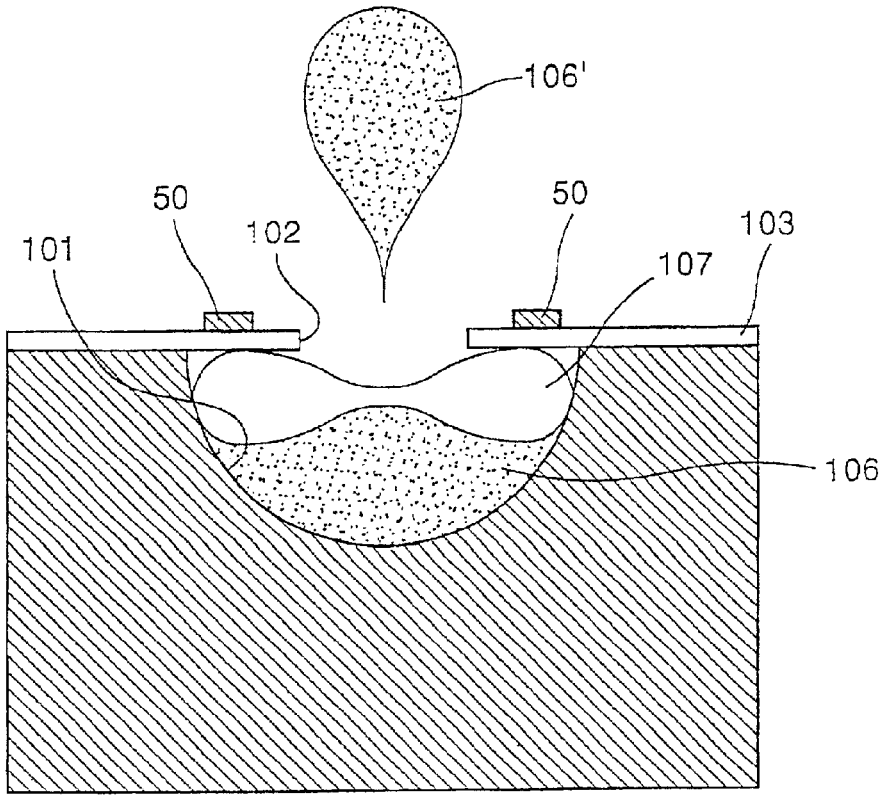
FIG. 14A is a cross-sectional view showing a state in which the bubble formed by the heater grows to cause ink to be ejected in the ink-jet printhead according to the first embodiment of the present invention.

Then, when heat generation from the heater 50*c* continues to go on, as shown in FIG. 14A, the bubbles A' significantly grow while bubbles B' grow at the low resistance portions, thus causing a droplet 106' to be ejected through the nozzle 102. Here, as shown in FIG. 14B, if the bubbles A' and B' reach a predetermined growth, all bubbles A' and B' merge, during which ink in a boundary line formed by the bubbles A' and B' is ejected by expansion energy from the bubbles A' and B'.

Figure 14B:
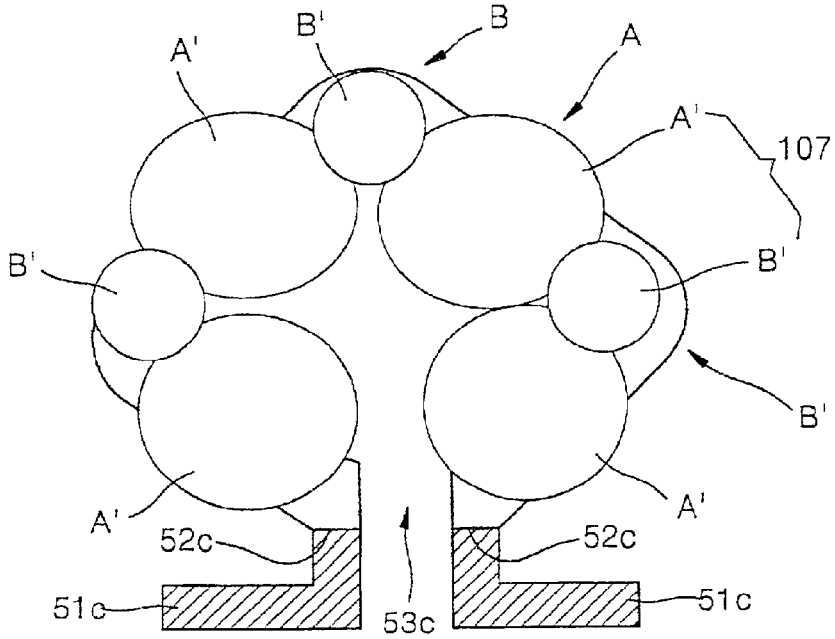
FIG. 14B is a top view of the heater at that time.

Although the bubbles A' at the high resistance portions A and the bubbles B' at the low resistance portions B are shown in independent forms in FIG. 14B to aid in understanding, FIG. 14B only shows an early phase of bubble growth. The bubbles A' and B' grow with a time lag, overlap each other, and coalesce into one bubble 107 to form a wholly doughnut-shaped bubble. If the bubble 107 grows further, as shown in FIG. 14A, the center portion of the doughnut-shaped bubble is filled with small bubbles or else has a very small diameter. When the bubbles A' and B' all coalesce into one larger bubble in this way, the bubble exerts maximum pressure on the ink 106 thus causing a droplet 106' to be ejected. In the above structure, although the heater 50 is disposed on the outer surface of the nozzle plate 103, it may be disposed inside the nozzle plate 103 so as to be in direct contact with the ink 106.

Figure 15A:
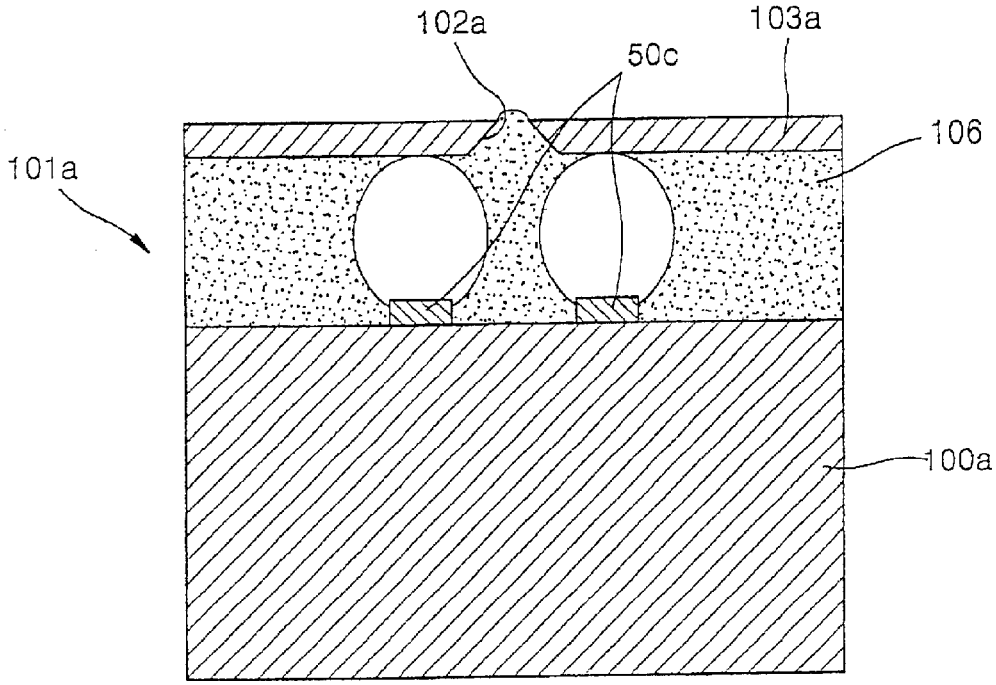
FIG. 15A is a cross-sectional view showing an early stage of bubble formation by a heater in an ink-jet printhead according to a second embodiment.

FIG. 15A shows a structure in which the heater 50*c* shown in FIG. 11A is applied to the ink-jet printhead shown in FIGS. 5 and 6. The nozzle plate 103*a* is separated from the substrate 100*a* a predetermined space and the common chamber 101*a* shared by all nozzles 102*a* is provided between the nozzle plate 103*a* and the substrate 100*a*. Referring to FIG. 15A, the heaters 50*c* that feature the present invention are formed on the bottom of the common chamber 101*a*, that is, on the surface of the substrate 100*a*. The heaters 50*c* is formed in such a way as to surround the central axis of the nozzle 102*a* formed in the nozzle plate 103*a*.

Figure 15B:
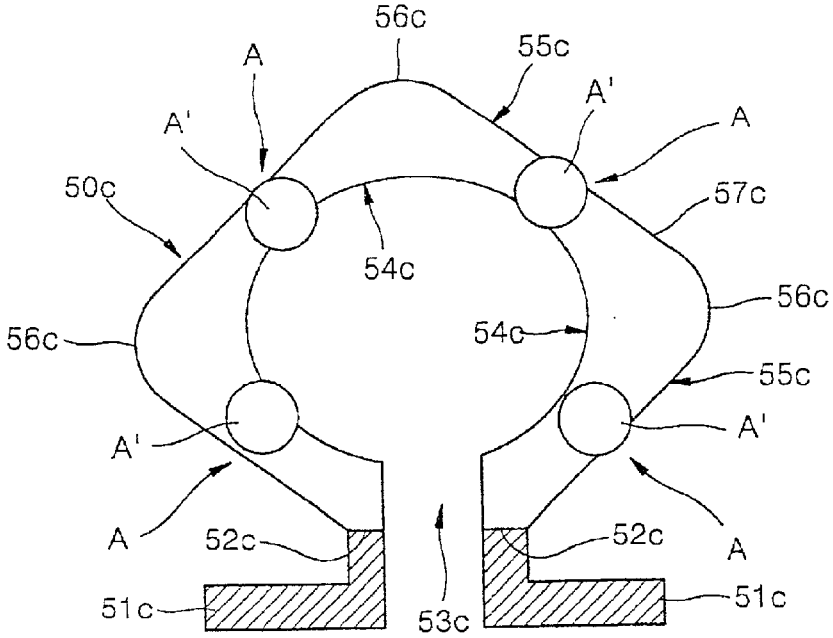
FIG. 15B is a top view of the heater at that time.

Upon applying current to the heater 50*c*, heat is generated from the heater 50*c* and then a bubble A' begins to be formed at the high resistance portion A where a temperature rises at the highest speed. In this case, as shown in FIG. 15B, the bubbles A' are formed at the high resistance portions A arranged at regular angles thereby imposing pressure on ink 106 within the ink chamber 101*a*.

Figure 16A:
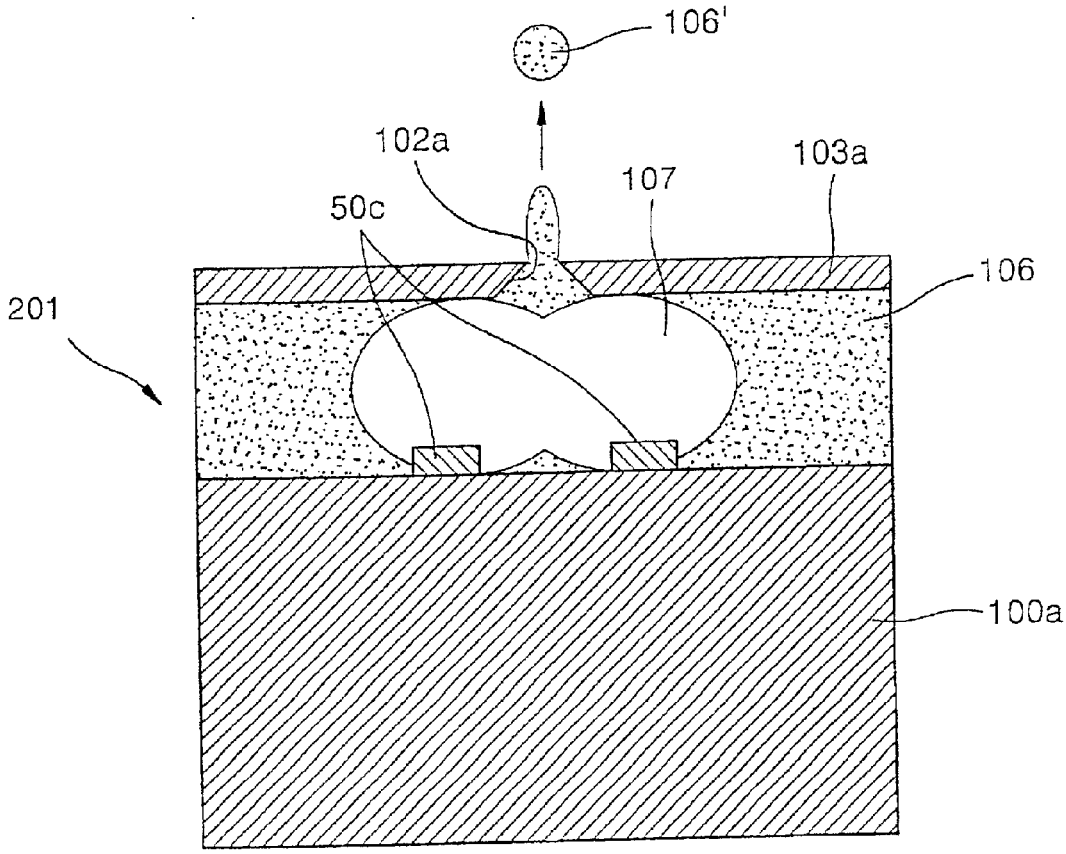
FIG. 16A is a cross-sectional view showing a state in which the bubble formed by the heater grows to cause ink to be ejected in the ink-jet printhead according to the second embodiment of the present invention.

Then, when heat generation from the heater 50*c* continues to go on, as shown in FIG. 16A, the bubbles A' significantly grow while the bubbles B' grow at the low resistance portions B between the bubbles A', thus causing a droplet 106' to be ejected through the nozzle 102*a*. Here, if the bubbles A' and B' reach a predetermined growth, all bubbles A' and B' merge, during which ink in a boundary line formed by the bubbles A' and B' is ejected by expansion energy from the bubbles A' and B'.

Figure 16B:
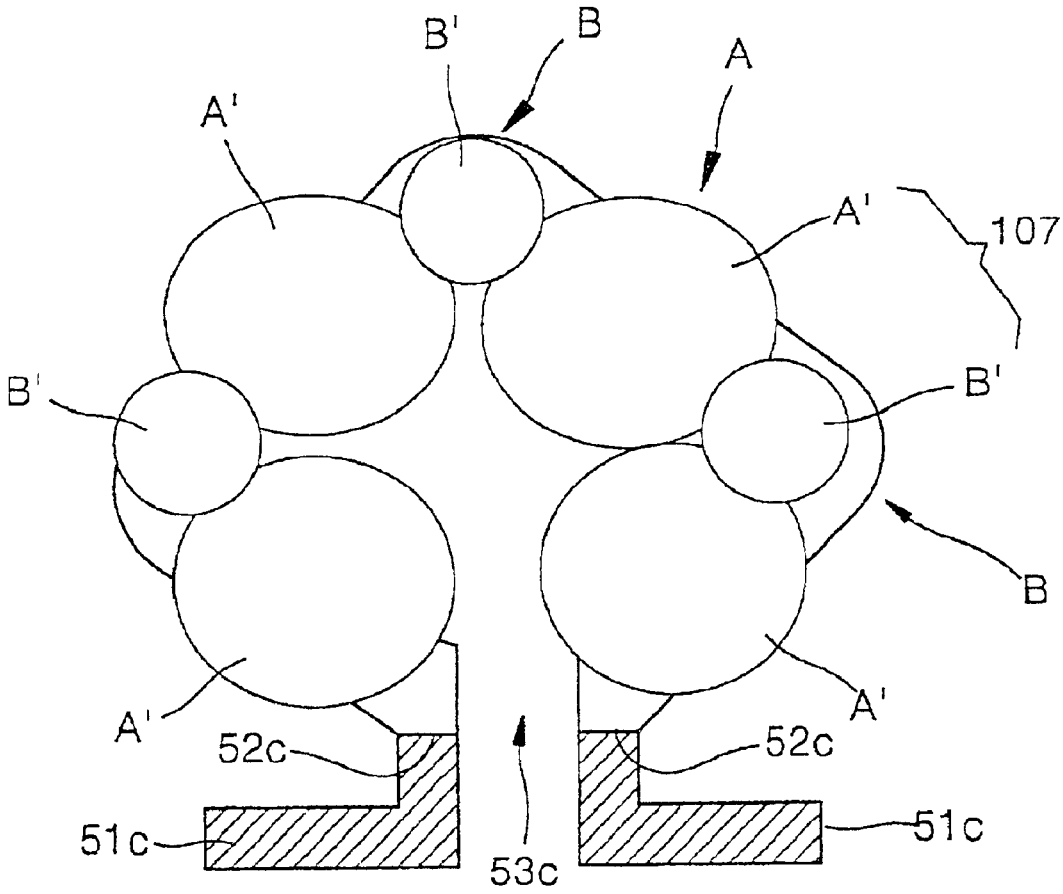
FIG. 16B is a top view of the heater at that time.

Although the bubbles A' at the high resistance portions A and the bubbles B' at the low resistance portions B are shown in independent forms in FIG. 16B to aid in the understanding, FIG. 16B only shows an early phase of bubble growth. The bubbles A' and B' grow with a time lag, overlap each other, and coalesce into one bubble to form a wholly doughnut-shaped bubble. If the bubble grows further, as shown in FIG. 16B, the middle portion of the doughnut-shaped bubble is filled with small bubbles or else has a very small diameter. When the bubbles A' and B' all coalesce into one larger bubble in this way, the bubble exerts maximum pressure on the ink 106 thus causing a droplet 106' to be ejected.

In the ink-jet printheads according to preferred embodiments of the present invention, a silicon substrate having a crystal orientation of 100 and a thickness of about 500 $\mu$m is applied as the substrates 100 and 100*a*. An oxide layer is formed on the silicon substrate by submitting the silicon wafer to a high temperature furnace in which oxygen gas is injected at a low pressure. The heaters 50*a*–50*f* are formed of a material such as polysilicon or TaAl and conductors or electrodes connected to the heaters 50*a*–50*f* are formed of aluminum.

In the case of the heater formed of polysilicon, the polysilicon may be deposited to a thickness of about 0.8 $\mu$m by low pressure chemical vapor deposition, and then the polysilicon deposited over the entire surface of the wafer is patterned by a photo process using photomask and photoresist and an etching process for etching the polysilicon layer deposited on the entire surface of a silicon oxide layer using a photoresist pattern as a etch mask.

The electrodes for applying current to the heaters 50*a*–50*f* are formed by depositing a metal having good conductivity such as Al to a thickness of about 1 $\mu$m by means of sputtering and patterning the same. Alternatively, the electrodes may be formed of copper by electroplating.

While this invention has been particularly shown and described with reference to preferred embodiments thereof, it will be understood by those skilled in the art that various changes in form and details may be made therein without departing from the spirit and scope of the invention as defined by the appended claims. For example, each component in a printhead according to the present invention may be formed of a material that is not illustrated. That is, the substrate may be formed of a material having good processibility instead of silicon, and the same is true of the heater or electrode connected thereto. Furthermore, methods of stacking and forming each material are only examples and hence various deposition etching techniques may be applied.

As described above, the ink-jet printhead according to the present invention allows bubbles to be first grown around the heater that surrounds the central axis of the nozzle at regular angles followed by the formation of another bubble between the earlier formed bubbles, thereby forming a larger doughnut-shaped bubble. This can prevent the formation of an unbalanced doughnut-shaped bubble due to variations in local resistance of the heater which may be caused by a process error. Furthermore, the printhead according to the present invention allows the center of the doughnut-shaped bubble to be set on the central axis of the nozzle thus causing a droplet formed within the doughnut-shaped bubble to be ejected in a normal manner, that is, in a direction vertical to the nozzle plate.

It should be understood that the present invention is not limited to the particular embodiments disclosed herein as the best mode contemplated for carrying out the present invention, but rather that the present invention is not limited to the specific embodiments described in this specification except as defined in the appended claims.

What is claimed is:

1. A bubble-jet inkjet printhead, comprising:

a substrate having a hemispherical ink chamber formed therein to hold ink supplied from a manifold;

a nozzle plate supported by said substrate and perforated by a nozzle through which said ink is ejected, said nozzle having a central axis that coincides with a central axis of said hemispherical ink chamber;

a heating element having an inner edge and an outer edge, said inner edge of said heating element surrounding said nozzle, said heating element having a plurality of high resistance portions and a plurality of low resistance portions, wherein said low resistance portions and high resistance portions are positioned alternately along a circumference of said heating element; and a pair of electrodes electrically connected to said heating element to apply current to said heating element when electricity is applied to said pair of electrodes, wherein said inner edge of said heating element has an essentially circular shape, said outer edge of said heating element has a polygonal shape and, said heating element is continuous and closed.

2. The printhead of claim 1, wherein said inner edge of said heating element has an essentially circular shape, said outer edge of said heating element has a polygonal shape and the corners of said outer edge of said heating element are rounded, wherein one section of said heating element is discontinuous and open.

3. The printhead of claim 2, wherein said heating element is made of a homogeneous material.

4. The printhead of claim 1, wherein said heating element is made of a homogeneous material.

5. The printhead of claim 1, wherein said heating element is disposed on said nozzle plate, said heating element produces a doughnut-shaped bubble that expands in a direction away from said nozzle.

6. The printhead of claim 8, wherein said pair of electrodes are electrically connected to opposite sides of said heating element.

7. The printhead of claim 1, wherein a resistance of said heating element is varied around the circumference of said heating element by varying a thickness of said heating element around the circumference.

8. The printhead of claim 1, wherein a resistance of said heating element is varied around the circumference of said heating element by varying a width of said heating element around the circumference.

9. A bubble-jet type printhead having a plurality of nozzles for ejecting droplets of ink therethrough, comprising:

a plurality of heating elements each associated with, and providing energy for said ejection of droplets of ink to, respective one of said plurality of nozzles, each of said plurality of heating elements being constructed of homogeneous material, and having at least one high resistance portion and at least one low resistance portion, wherein an inner edge of each heating element has an essentially circular shape, an outer edge of each heating element has a polygonal shape and the corners of said outer edge of each heating element are rounded, wherein one section of said heating element is discontinuous and open.

10. The printhead of claim 9, wherein the high resistance portions and the low resistance portions are positioned alternately so that a high resistance portion or a low resistance portion is interposed between two adjacent low resistance portions or high resistance portions.

11. The printhead of claim 9, wherein the resistance values of resistance portions of said heating element are varies by varying a width of said heating element.

12. The printhead of claim 9, each high resistance portion of each of said plurality of heating elements is disposed between a pair of low resistance portions.

13. The printhead of claim 9, each one of said plurality of heating elements being attached to a nozzle plate.

14. The printhead of claim 13, each nozzle corresponding to an individual cavity formed in a substrate.

15. The printhead of claim 14, said inner edge of each heating element surrounds an outer edge of respective ones of said plurality of nozzles.

16. The printhead of claim 13, each one of said plurality of heating elements has a central axis that is coincident with respective ones of said plurality of nozzles.

17. The printhead of claim 13, said inner edge of each heating element surrounds an outer edge of respective ones of said plurality of nozzles.

18. A bubble-jet type ink jet printhead, comprising:

a substrate having a cavity formed therein to a predetermined depth and filled with ink supplied from a manifold;

a nozzle plate supported by said substrate and perforated by a nozzle hole having an outer edge through which said ink is ejected, said nozzle hole having a central axis, each nozzle hole disposed over a center of said cavity formed in said substrate;

a heating element having an inner edge and an outer edge, said inner edge surrounding said outer edge of said nozzle hole, said heating element having a resistance of which varies at regular intervals around said heating element, said heating element being attached to said nozzle plate; and a pair of electrodes electrically connected to said heating element which apply current to said heating element, when electricity is applied to said pair of electrodes, wherein said inner edge of said heating element has an essentially circular shape, said outer edge of said heating element has a polygonal shape and, said heating element is continuous and closed.

19. The printhead of claim 18, said inner edge of said heating element has an essentially circular shape, said outer edge of said heating element has a polygonal shape and corners of the outer edge of said heating element being rounded, wherein one section of said heating element being discontinuous and open.

20. The printhead of claim 19, heating element having a resistance that varies at regular intervals comprises said heating element being made of a homogenous material, said heating element having a low resistance portion disposed between a pair of high resistance portions and a high resistance portion being disposed between a pair of low resistance portions, said low resistance portions being at said rounded corners.

21. The printhead of claim 18, said heating element having a resistance that varies at regular intervals comprises said heating element being made of a homogenous material, said heating element having a low resistance portion disposed between a pair of high resistance portions and a high resistance portion being disposed between a pair of low resistance portions.

* * * * *